United States Patent [19]

Beckett

[11] 4,206,805

[45] Jun. 10, 1980

[54] HEAT RECOVERY UNIT

[76] Inventor: Ralph R. Beckett, 1410 2nd Ave., Yuma, Ariz. 85364

[21] Appl. No.: 891,731

[22] Filed: Mar. 30, 1978

[51] Int. Cl.[2] ..... F28F 9/22

[52] U.S. Cl. ..... 165/80 C; 62/238; 62/324; 165/169; 165/176; 165/185

[58] Field of Search ..... 62/238 E, 324 D, 508; 165/169, DIG. 12, 80, 185, DIG. 7, DIG. 2, 106, 77, 80 R, 80 C, 80 E, 176

[56] References Cited

U.S. PATENT DOCUMENTS

| | | | |
|---|---|---|---|
| 2,059,297 | 11/1936 | Widman et al. | 165/169 |
| 2,175,914 | 10/1939 | Philipp | 62/508 |
| 2,324,533 | 7/1943 | Pearson et al. | 165/80 E |
| 2,700,279 | 1/1955 | Stickel | 62/238 E |
| 3,222,448 | 12/1965 | Rogers et al. | 165/80 B |
| 3,333,771 | 8/1967 | Graham | 122/26 |
| 3,553,976 | 1/1971 | Cumine | 165/169 |

FOREIGN PATENT DOCUMENTS

| | | | |
|---|---|---|---|
| 252634 | 4/1963 | Australia | 62/238 E |

*Primary Examiner*—S. J. Richter

*Attorney, Agent, or Firm*—Clarence A. O'Brien; Harvey B. Jacobson

[57] ABSTRACT

A device is disclosed for recovery of heat from hot shell devices, particularly from motor-compressor units such as used in air conditioners, refrigeration systems and the like and which comprises a heat exchange coil in encircling, contacting heat exchange relationship to the hot shell device with circulation of a fluid through the heat exchange coil to recover normally wasted heat. Heat absorbed can be utilized to heat domestic hot water for home heating or for tap use.

5 Claims, 4 Drawing Figures

HEAT RECOVERY UNIT

BACKGROUND OF THE INVENTION

1. Field of the Invention

The present invention relates generally to heat recovery apparatus, and more particularly to the combination of a compressor unit and a heat exchange coil in encircling, contacting, heat exchange relationship to the unit with liquid circulation through the heat exchange coil.

2. Description of the Prior Art

Heat exchange equipment is known for removal of heat from various sources.

Philipp in U.S. Pat. No. 2,175,914 discloses a heat exchange coil connected directly to the housing of a motor-compressor unit for cooling such unit through dissipation of transferred heat into the atmosphere. Philipp uses a refrigerant circulating through a jacket in thermal contact with sealed casing walls of the motor-compressor unit, during which vaporization of refrigerant occurs.

Wilkes et al., in U.S. Pat. No. 2,095,017 operate domestic water heaters on a heat pump principle which results in supplying, rather than recovery, of heat.

Stickel in U.S. Pat. No. 2,700,279 recovers heat from a refrigerating system to heat water, but does not employ a jacket-type heat reclamation system.

Smith in U.S. Pat. No. 2,976,699 and Rataiczak in U.S. Pat No. 2,420,442 draw heat from the condenser units of refrigeration equipment, rather than from a hot shell device.

SUMMARY OF THE INVENTION

An object of the present invention is to recover the heat of compression, friction or electric motor loss from air conditioning equipment, hot gas devices, heat pump equipment, or any hot shell device. Increasing cost of energy, coupled with the prospect of diminishing supplies of energy, mandate development of new sources of energy and recovering and using normally wasted heat. The present invention helps to fill the need for conserving energy by recovering otherwise wasted heat.

Another object of the invention is to provide heat recovery equipment which can be clamped directly to the shell of existing refrigeration or air conditioning equipment without disturbing existing equipment connecting lines.

A further object of the invention is to provide means for prolonging life and increasing efficiency of the device constituting the heat source, which may in certain applications be a compressor or electric motor.

Still another object of the present invention is to permit heating of domestic water for kitchen, restaurant or other use without the possibility of introduction of foreign gases or liquids which could constitute an environmental health problem.

Still another feature of the present invention is its simplicity, having no moving parts and, for certain applications, requiring no additional auxiliary energy input in providing heat.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
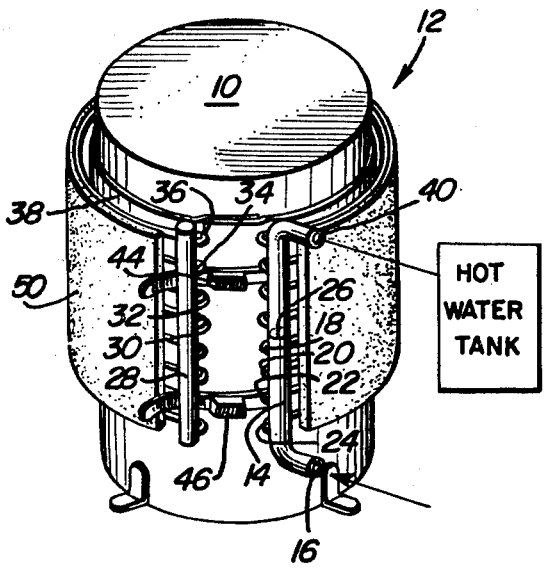
FIG. 1 is a perspective view of the heat recovery device of the present invention.
Figure 2:
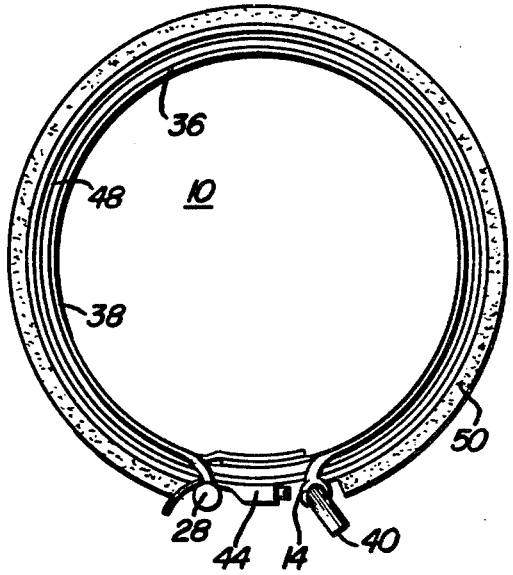
FIG. 2 is a top plan view of the heat recovery device of the present invention.

Referring now specifically to the drawings, the heat recovery device of the present invention, designated generally in FIG. 1 by numeral 12, encircles a heat source 10, which may be a hot shell device.

Figure 3:
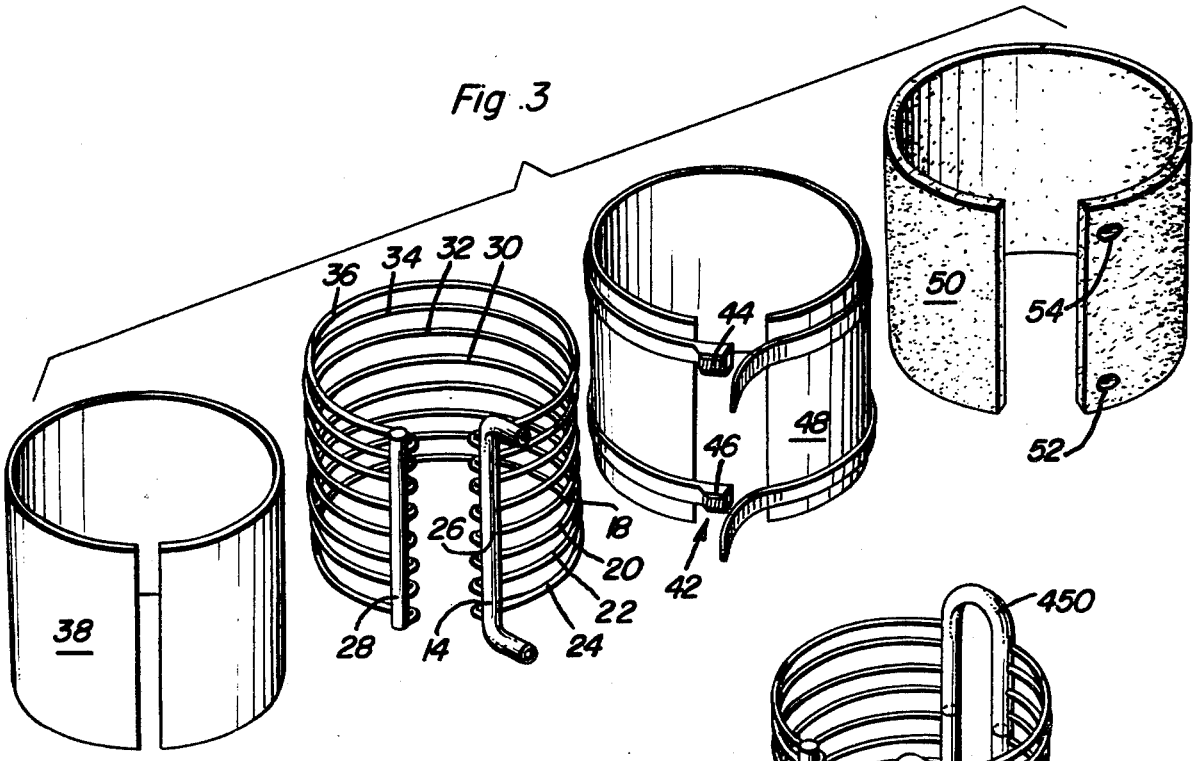
FIG. 3 is a group perspective view of the components of the heat recovery device, showing from left to right the order of assembly.

Water to be heated enters header 14 through inlet 16 and passes into coils 18, 20, 22 and 24, being prevented from travelling above the level of coil 18 in terminal header 14 by a barrier plug (not shown), the seam 26 of which appears in FIGS. 1 and 3. The path followed by the circulating fluid is best seen in the second of the group perspective drawings comprising FIG. 3, where fluid is carried into transfer header 28 from the lower four coils. Travelling upward through transfer header 28, circulating fluid enters coils 30, 32, 34 and 36, returning to the terminal header 14 in the portion of terminal header 14 above the plug at seam 26. In the course of circulation, the circulating fluid which entered at inlet 16 has absorbed heat through direct mechanical and thermal contact with inner heat absorber 38, which, in turn, is in mechanical and thermal contact with heat source 10. Heated fluid is then discharged from outlet 40 for use as domestic water or use in other applications. Inner heat absorber 38 is adjustable in circumference to accommodate variations in diameter of heat sources.

Surrounding the eight coils is an outer shield, designated generally by numeral 42 in FIG. 3. Outer shield 42 serves to protect coils from damage from the outside, and additionally, provides the means to assemble and hold stationary the heat recovery device, through tightening of worm clamps 44 and 46. Outer shield 42 comprises metal sheet 48, which can be copper. Tightening of worm clamps 44 and 46 compresses metal sheet 48 causing the coils and inner heat absorber 38 to compress to the degree necessary for the entire assembly to be held frictionally together.

Optionally, a layer of suitable insulation can surround the outer shield 42 to reduce heat loss by radiation and conduction to the surrounding environment. If used, the surrounding insulation layer 50 can be anchored by bolts or other means, as represented at points 52 and 54. Insulation layer 50 can be a unitary cylindrical sheet, or can comprise a metal frame containing loose insulating filler such as asbestos fibers.

Figure 4:
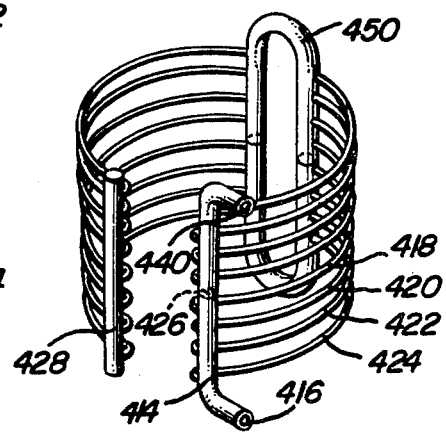
FIG. 4 is a perspective view of a second embodiment of the heat recovery device of the present invention.

An alternative embodiment of the present invention, providing for greater reversal of flow, is shown in FIG. 4. Fluid to be heated enters the apparatus through inlet 416, proceeding into terminal header 414 and being distributed into coils 418, 420, 422 and 424. Fluid is prevented from travelling above the level of coil 418 in terminal header 414 by a barrier plug (not shown), the seam 426 at which appears in FIG. 4. However, transfer through loop header 450 causes fluid discharged from these four pipes to mix before continuing to transfer header 428. Barrier plugs (not shown) in loop header 450, the seams 452 and 454 of which are shown in FIG. 4, prevent the passage of fluid into the upper portion of loop header 450, directing the fluid through coils as shown by arrows in FIG. 4 into transfer header 428. Passing upward in transfer header 428, fluid travels as indicated to the upper portion of loop header 450. Mixing again occurs in the upper portion of loop header 450 before heated fluid is gathered in the upper portion of terminal header 414 for discharge through outlet 440.

All coils and headers described above are preferably made of a metal with high thermal conductivity, such as copper or silver. Copper is most preferred.

As illustrated in FIG. 1, the heat recovery device may be used as a preheater for water entering a domestic hot water tank associated with the usual plumbing in a conventional manner. Also, the heated water may be used for any other desired purpose. The device may be easily mounted on existing motor-compressor units without modification and without disturbing any refrigerant lines or other equipment. There is no contamination of potable water passing through the device and also decreases the operating temperature of the motor-compressor unit to improve the efficiency of operation and prolong useful life expectancy of such equipment.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. Heat recovery apparatus comprising, in combination, a heat source and encircling inner heat absorber in mechanical and thermal contact with said heat source, an assembly of a plurality of encircling heat exchange coils surrounding and in mechanical and thermal contact with said inner heat absorber, said coils including inlet and outlet means for circulation of a heat exchange fluid, and an outer shield surrounding said assembly, said outer shield having means for adjustably tightening and frictionally holding said assembly and said inner heat absorber to said heat source, wherein a loop manifold is interposed within the path of said coils comprising said assembly.

2. Apparatus of claim 1 wherein an insulation layer surrounds said outer shield.

3. The apparatus of claim 2 wherein said insulation layer comprises a unitary cylindrical sheet anchored to said outer shield, whereby heat loss by radiation in conduction to the surrounding environment is reduced.

4. The apparatus of claim 1 wherein said heat source is a motor-compressor unit.

5. The apparatus of claim 1 wherein said fluid is water.

* * * * *